US010814291B2

(12) United States Patent
Chen et al.

(10) Patent No.: US 10,814,291 B2
(45) Date of Patent: Oct. 27, 2020

(54) METHOD FOR IN SITU MIXING OF LIQUID COMPOSITIONS WITH OFFSET LIQUID INFLUX

(71) Applicant: The Procter & Gamble Company, Cincinnati, OH (US)

(72) Inventors: Hongling Chen, Beijing (CN); Boon Ho Ng, Beijing (CN); Chong Gu, Beijing (CN); Qi Zhang, Zhang (CN); Scott William Capeci, North Bend, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 197 days.

(21) Appl. No.: 16/001,970

(22) Filed: Jun. 7, 2018

(65) Prior Publication Data

US 2018/0353915 A1 Dec. 13, 2018

(30) Foreign Application Priority Data

Jun. 8, 2017 (WO) ..... PCT/CN2017/087538

(51) Int. Cl.

| | |
|---|---|
| ***B01F 5/02*** | (2006.01) |
| ***B01F 3/08*** | (2006.01) |
| ***C11B 9/00*** | (2006.01) |
| ***B67C 3/02*** | (2006.01) |
| ***B65B 3/04*** | (2006.01) |
| *B01F 5/00* | (2006.01) |

(52) U.S. Cl.

CPC ..... *B01F 5/0281* (2013.01); *B01F 3/0865* (2013.01); *B01F 5/02* (2013.01); *B65B 3/04* (2013.01); *B67C 3/023* (2013.01); *C11B 9/00* (2013.01); *B01F 2005/0037* (2013.01); *B01F 2215/0422* (2013.01)

(58) Field of Classification Search

CPC ..... B01F 5/0281; B01F 3/0865; B01F 2215/0422; B01F 2005/0037; C11B 9/00; B67C 3/023; B65B 3/04

See application file for complete search history.

(56) References Cited

U.S. PATENT DOCUMENTS

| | | | | |
|---|---|---|---|---|
| 5,324,109 | A | 6/1994 | Johari | |
| 9,918,584 | B2 | 3/2018 | Bergdahl et al. | |
| 2008/0140261 | A1 | 6/2008 | Hansen | |
| 2009/0236364 | A1* | 9/2009 | Njaastad | B67D 1/16 222/108 |

(Continued)

FOREIGN PATENT DOCUMENTS

| | | | |
|---|---|---|---|
| CN | 101249393 | B | 12/2011 |
| CN | 102223828 | B | 3/2014 |

(Continued)

OTHER PUBLICATIONS

Harf, "Liquid Coffee Dispensers and Concentrate," Aquapresso, Nov. 12, 2014. (Year: 2014).*

(Continued)

*Primary Examiner* — Catherine S Branch

(74) *Attorney, Agent, or Firm* — Gary J. Foose

(57) ABSTRACT

Methods for in situ mixing of two or more different liquid compositions in a container by employing one or more liquid influxes that are offset by 1-50° from a longitudinal axis of such container.

20 Claims, 4 Drawing Sheets

(56) References Cited

U.S. PATENT DOCUMENTS

| | | | | |
|---|---|---|---|---|
| 2011/0177220 | A1* | 7/2011 | Bergdahl | A47J 31/46 426/433 |
| 2011/0297274 | A1 | 12/2011 | Hilliard, Jr. | |
| 2014/0182743 | A1* | 7/2014 | Trulaske | B67D 1/1272 141/271 |
| 2015/0020916 | A1 | 1/2015 | Menon | |
| 2016/0114527 | A1 | 4/2016 | Goudy | |

FOREIGN PATENT DOCUMENTS

| | | | |
|---|---|---|---|
| CN | 102341161 | B | 5/2015 |
| EP | 1947169 | A1 | 7/2008 |
| WO | WO03097516 | A1 | 11/2003 |
| WO | WO2010034722 | A1 | 4/2010 |
| WO | WO2011133456 | A1 | 10/2011 |

OTHER PUBLICATIONS

Uli, "Suicide Solution," Half Past Awesome, Aug. 6, 2009. (Year: 2009).*

Parker, "Water's impact on fountain beverages and beverage systems: Part 2," Water Tech Online, Oct. 1, 2003. (Year: 2003).*

U.S. Appl. No. 16/001,965, filed Jun. 7, 2018, Boon Ho Ng.

PCT_Search_Report for International App. No. PCT/CN2017/087537, dated Mar. 12, 2018, 4 pages.

Search_Report for International App. No. PCT/CN2017/087538, dated Mar. 8, 2018, 4 pages.

International Search Report for International Application Serial No. PCT/CN2017/087538, dated Feb. 24, 2018, 6 pages.

Supplementary International Search Report for International Application Serial No. PCT/CN2017/087538, dated Aug. 13, 2019, 7 pages.

* cited by examiner

METHOD FOR IN SITU MIXING OF LIQUID COMPOSITIONS WITH OFFSET LIQUID INFLUX

FIELD OF THE INVENTION

This disclosure relates to methods for in situ mixing of two or more different liquid compositions, and especially for the purpose of forming a homogeneous and stable liquid composition inside a container.

BACKGROUND OF THE INVENTION

Traditional industry-scale methods for forming liquid consumer products (e.g., liquid laundry detergents, liquid fabric care enhancers, liquid dish-wash detergents, liquid hard-surface cleaners, liquid air fresheners, shampoos, conditioners, body-wash liquids, liquid hand soaps, liquid facial cleansers, liquid facial toners, moisturizers, and the like) involve mixing multiple raw materials of different colors, density, viscosity, and solubility in large quantities (e.g., through either batch mixing or continuous in-line mixing) to first form a homogenous and stable liquid composition, which is then filled into individual containers, followed subsequently by packaging and shipping of such containers. Although such traditional methods are characterized by high throughput and satisfactory mixing, the nevertheless suffer from lack of flexibility. If two or more different liquid consumer products need to be made using the same production line, the production line needs to be cleaned or purged first before it is used to make a different liquid consumer product. Such cleaning or purging step also generates a significant amount of "waste" liquid that cannot be used in either product.

There is therefore a need for more flexible industry-scale methods for forming liquid consumer products that are well mixed with satisfactory homogeneity and stability. It is further desired that such methods generate little or no "waste" liquid and allow maximum utilization of the raw materials.

SUMMARY OF THE INVENTION

This disclosure provides an in situ liquid mixing method, i.e., two or more liquid raw materials are mixed directly inside a container (e.g., a bottle, a pouch or the like) that is designated for housing a finished liquid consumer product during shipping and commercialization of such product, or even during usage after such product has been sold. More specifically, the present disclosure employs one or more liquid influxes for filling the container that are not aligned with the longitudinal axis of the container, but are offset from such longitudinal axis by a sufficiently large offset angle ($\alpha$), e.g., from about 1° to about 50°. Such offset or angled liquid influxes function to increase the impact of available kinetic energy on the mixing result and in turn improve homogeneity and stability of the finished liquid consumer product so formed.

The present disclosure relates to a method of filling a container with liquid compositions, including the step of:

(A) providing a container that has an opening with a centroid, a supporting plane, and a longitudinal axis that extends through the centroid of the opening and is perpendicular to such supporting plane, while the total volume of the container ranges from 10 ml to 10 liters;

(B) providing a first liquid feed composition and a second liquid feed composition that is different from the first liquid feed composition;

(C) partially filling the container with the first liquid feed composition to from about 0.01% to about 50% of the total volume of such container; and (D) subsequently, filling the remaining volume of the container, or a portion thereof, with the second liquid feed composition, while during step (D), the second liquid feed composition is filled through the opening into said container by one or more liquid nozzles that are positioned immediately above the opening or inserted into said opening, and while such one or more liquid nozzles are arranged to generate one or more liquid influxes that are offset from the longitudinal axis of the container by an offset angle ($\alpha$) ranging from about 1° to about 50°.

Preferably, the offset angle ranges from about 4° to about 40°, and more preferably from about 10° to about 25°.

The supporting plane of the container may have a major axis and a minor axis, while the longitudinal axis of the container intersects the major axis of the supporting plane, and while the one or more liquid influxes preferably lie within the plane defined by the longitudinal axis of the container and the major axis of its supporting plane.

The container may be placed during step (D) so that its longitudinal axis extends along the vertical direction. In this manner, the one or more liquid influxes are also offset from the vertical direction by the same offset angle ($\alpha$).

The container may be placed during step (D) so that its longitudinal axis is offset from the vertical direction by the same offset angle ($\alpha$), while the one or more liquid influxes extend along the vertical direction.

The container may be placed during step (D) so that its longitudinal axis is offset from the vertical direction by a second offset angle ($\beta$) that is smaller than the previously mentioned offset angle ($\alpha$), while the at least one or more liquid influxes generated by the one or more liquid nozzles are offset from the vertical direction by a third offset angle ($\gamma$) that is equal to ($\alpha$)-($\beta$).

The container of the present disclosure preferably includes a top end, a bottom end, and one or more side walls that extend between the top end and the bottom end. The opening of such container may be located at its top end, while the supporting plane of such container is located at its bottom end, i.e., the bottom end defines the supporting plane of such container, and while the one or more liquid influxes reach at least one of the side walls of such container at below about 50%, preferably below about 25%, and more preferably below about 20%, of the height of said at least one side wall.

The one or more liquid influxes may have an average flow rate ranging from about 50 ml/second to about 10 L/second, preferably from about 100 ml/second to about 5 L/second, more preferably from about 500 ml/second to about 1.5 L/second. Correspondingly, the total time for filling the second liquid composition during step (D) ranges from 0.1 second to 5 seconds.

The first liquid feed composition is present in the container as a minor feed (e.g., containing one or more perfumes including perfume microcapsules, colorants, opacifiers, pearlescent aids such as mica, titanium dioxide coated mica, bismuth oxychloride, and the like, enzymes, brighteners, bleaches, bleach activators, catalysts, chelants, polymers, etc.), i.e., during step (C), 0.01-50%, preferably 0.1-50%, more preferably 0.1-40%, still more preferably 0.1-30%, still more preferably 0.1-20%, and most preferably 0.1-10% of the total volume of the container is filled with the first liquid feed composition. In addition, it is preferred that the second liquid feed composition is present in the container as a major feed (e.g., containing one or more surfactants, solvents, builders, structurants, polymers, perfume microcapsules, pH modifiers, viscosity modifiers, etc.), i.e., during step (D), at least 50%, preferably at least 70%, more preferably at least 80%, and most preferably at least 90%, of the total volume of the container is filled with the second liquid feed composition.

These and other aspects of the present disclosure will become more apparent upon reading the following detailed description.

DETAILED DESCRIPTION OF THE INVENTION

Figure 1:
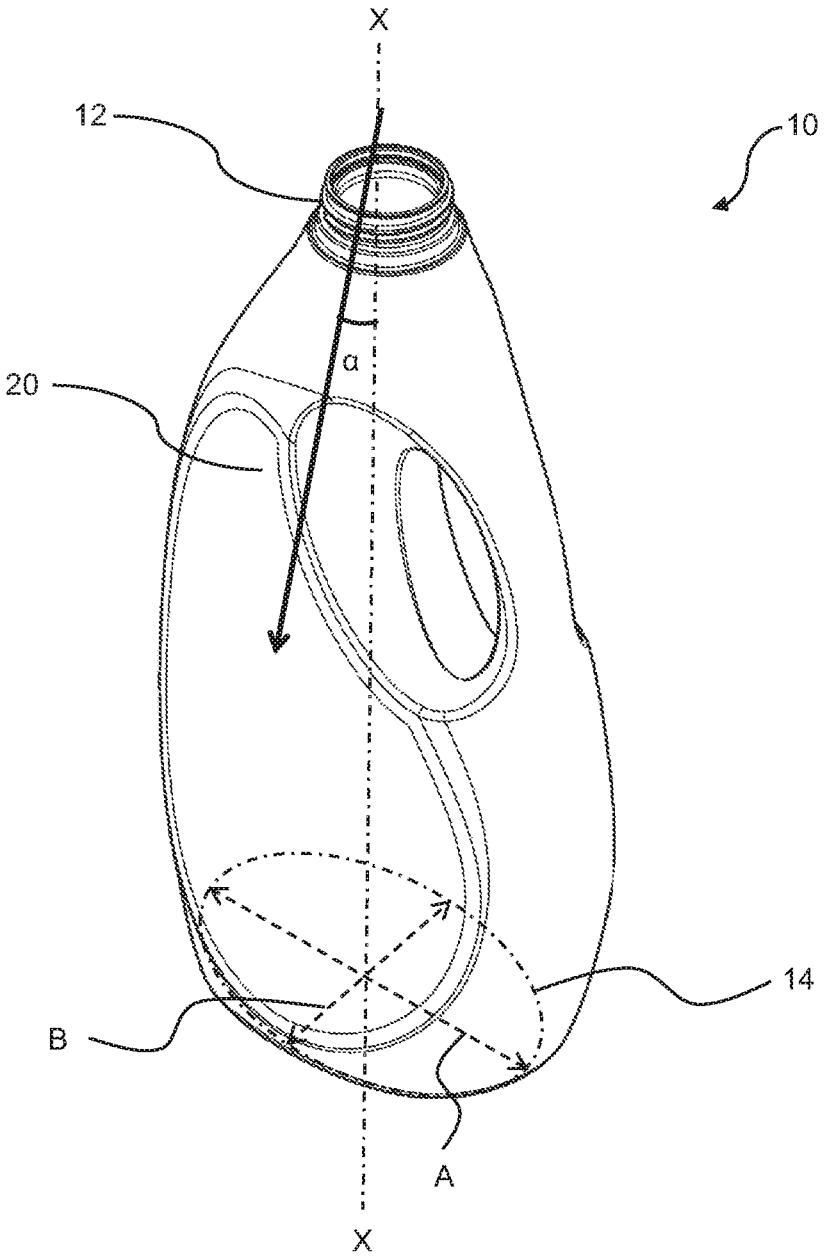
FIG. 1 is a perspective view of a bottle, which is being filled with a liquid feed composition (not shown) by a liquid influx that is offset from the longitudinal axis of the bottle by an offset angle ($\alpha$).

As used herein, the term "in situ" refers to real-time mixing that occurs inside a container (e.g., a bottle or a pouch) that is designated for housing a finished liquid consumer product (e.g., a liquid laundry detergent, a liquid fabric care enhancer, a liquid dish-wash detergent, a liquid hard-surface cleaner, a liquid air freshener, a shampoo, a conditioner, a liquid body-wash, a liquid hand soap, a liquid facial cleanser, a liquid facial toner, a moisturizer, and the like) during shipping and commercialization of such product, or even during usage after such product has been sold. In situ mixing of the present invention is particularly distinguished from the in-line mixing that occurs inside one or more liquid pipelines that are positioned upstream of the container, and preferably upstream of the filling nozzle(s). In situ mixing is also distinguished from the batch mixing that occurs inside one or more mixing/storage tanks that are positioned upstream of the liquid pipelines leading to the container.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

In order to achieve good homogeneity and stability in the finished liquid consumer products formed by in situ mixing, jet mixing is employed to impart a sufficient amount of kinetic energy into the liquid feeds as they enter the container (e.g., bottle or pouch). Inventors of the present invention have discovered that the employment of an offset or angled liquid influx (i.e., offset from or angled with the longitudinal axis of the container) for filling the container, especially during the major feed stage, may be effective in increasing the impact of a given amount of kinetic energy on the mixing results, while reducing undesired splashing or rebound of the liquid content inside the container.

The container according to the present disclosure is a container that is specifically designated for housing a finished liquid consumer product during shipping and commercialization of such product, or even during usage after such product has been sold. Suitable containers may include pouches (especially standup pouches), bottles, jars, cans, cartons that are water-proof or water-resistant, and the like.

Such container typically includes an opening through which liquids (either liquid raw materials or the finished liquid consumer products) can be filled into and dispensed from it. The opening can have different geometries and various cross-sectional shapes. For example, the opening be tubular or cylindrical with a substantial height and a circular or nearly circular cross-section. For another example, the opening may have a substantial height but an oval, triangular, square, or rectangular cross-section. For yet another example, the opening may have a minimal height that is negligible and is therefore only defined by its cross-sectional shape. Such opening has a center point or centroid. In a conventional liquid filling process, one or more liquid filling nozzles are placed either at such centroid or in its vicinity (e.g., either slightly above it or below it) for generating one or more vertical liquid influxes into the container.

The container also has a supporting plane, which is defined by three or more points upon which the container can stand alone stably, regardless of the shape or contour of its supporting surface. It is important that the presence of such a supporting plane does not require that the container have a flat supporting surface. For example, a container may have a concaved supporting surface, while the outer rim of such concave supporting surface defines a supporting plane upon which the container can stand alone stably. For another example, a container may have a supporting surface with multiple protrusions, while three or more such protrusions define a supporting plane upon which the container can stand alone stably.

The container may also have a top end, an opposing bottom end, and one or more side walls that extend between the top end and the bottom end. The above-mentioned opening is typically located at the top end of the container. The above-mentioned supporting plane can be located at the opposing bottom end of the container and is thus defined by a bottom surface of such container (e.g., a typical upstanding liquid bottle that stands on its bottom end). Alternatively, the above-mentioned supporting plane can be located at the top end of the container and is thus defined by a top surface of such container (e.g., an inverse liquid bottle that stands on its top end).

The container may also have a longitudinal axis that extends through the centroid of the above-mentioned opening and is perpendicular to the above-mentioned supporting plane. Please note that although preferred, it is not necessary for the container to have an elongated shape, i.e., the longitudinal axis is not defined by the shape of the container, but is rather defined by the location of the centroid of the container opening and the supporting plane of the container.

Such container may further contain one or more side walls between the top end and the bottom end. For example, such container may be a cylindrical or near cylindrical bottle with one continuous curved side wall that connects its top end and its bottom end, which defines a circular or oval shaped bottom surface. For another example, the container may be a standup pouch with two planar side walls that meet at its bottom end to form an almond-shaped bottom surface as well as at its top end to form a straight-line opening/closure. Further, the container may have three, four, five, six or more planar or curved side walls that connect the top end and the bottom end.

The container of the present invention is filled with two or more different liquid feed compositions, which will mix in situ inside such container. Such liquid feed compositions may differ in any aspect, e.g., colors, density, viscosity, and solubility, that may potentially lead to inhomogeneity or phase separation in the resulting mixture.

Preferably, the container is first filled with a first liquid feed composition, which may be present in the container as a minor feed, i.e., the first liquid feed composition only fills up to about 0.01-50%, preferably about 0.01-50%, more preferably 0.1-40%, still more preferably about 1-30%, still more preferably about 0.1-20%, and most preferably about 0.1-10% of the total volume of the container. Such a minor feed composition may contain, for example, one or more perfumes (including perfume microcapsules), colorants, opacifiers, pearlescent aids, enzymes, brighteners, bleaches, bleach activators, catalysts, chelants, or polymers, or combinations thereof. Preferably, such minor feed composition contains at least one pearlescent aid selected from the group consisting of mica, titanium dioxide coated mica, bismuth oxychloride, and combinations thereof. Note that the present invention is not limited to a single minor feed, and may include two or more minor feeds that are simultaneously or sequentially filled into the container to form such minor feed composition as a mixture of such two or more minor feeds.

Next, the container is preferably filled with a second liquid feed composition, which may be present in the container as a major feed, i.e., the second liquid feed composition fills at least about 50%, preferably at least about 70%, more preferably at least about 80%, and most preferably at least about 90%, of the total volume of the container. Such a major feed composition may contain, for example, one or more surfactants, solvents, builders, structurants, polymers, perfume microcapsules, pH modifiers, viscosity modifiers, or combinations thereof. Note that the present invention is not limited to a single major feed, and may include two or more major feeds that are simultaneously or sequentially filled into the container to form such major feed composition as a mixture of such two or more major feeds.

Subsequently, the container can be filled with one or more additional liquid feed compositions containing one or more additives or benefit agents needed for forming the finished liquid consumer products of the present invention.

Filling of the container is carried out by one or more liquid nozzles, which are designed for generating one or more liquid influxes into the container through the opening of the container. The nozzles may be of any size or form that are suitable for jet-filling of liquid contents. Preferably, the nozzles are pressurized, e.g., with an applied pressure ranging from about 0.5 bar to about 20 bar, preferably from about 1 bar to about 15 bar, and more preferably from about 2 bar to about 6 bar.

Specifically, such nozzles are position either immediately above the container opening, or inserted into the container opening. The term "immediately above" as used herein means that the distance between the outlet of each nozzle and the upper rim of the container opening is less than about 5 mm, preferably less than about 2 mm, and more preferably less than about 1 mm. If the nozzles are inserted into the container opening, the distance between the outlet of each nozzle and the lower rim of the container opening (i.e., the insertion distance) may preferably range from about 5 mm to about 10 cm, more preferably from about 1 cm to about 8 cm, and most preferably from about 3 cm to about 5 cm. In a particularly preferred embodiment, the nozzles are inserted deep into the container to be positioned at about 1-5 cm, preferably about 2-3 cm, above the liquid surface inside the container, and are moving up together with the liquid surface as the filling proceeds. The above described positions or arrangements of the nozzle function to increase the impact of a given amount of kinetic energy (as imparted to the liquid influx) on the mixing results, while reducing undesired splashing or rebound of the liquid content inside the container.

The liquid influx that fills the container with the second liquid feed composition, i.e., the major feed liquid influx, is angled or offset from the longitudinal axis of the container by a significantly large offset angle ($\alpha$), e.g., from about 1° to about 50°, preferably from about 5° to about 40°, and more preferably from about 10° to about 25°.

In the present invention, it is particularly preferred that the offset angle ($\alpha$) is large enough so that the major feed liquid influx, after entering the container, hits one of the side walls of the container, instead of its bottom plane. When the major feed liquid influx hits one of the side walls of the container, it will be first deflected by the side wall downward to the bottom plane, and then by the bottom plane for a second time to potentially reach the opposing side wall, thereby generating a relatively strong and relatively large vortex inside the container. Such vortex helps to achieve good mixing between the major feed and minor feed(s) already in the container. In contrast, if the major feed liquid influx hits the bottom plane first, it will be deflected upward to one of the side walls, but further deflection by the side wall is likely weaker in force and smaller in scale, thereby unable to form a sufficiently forceful and large vortex to achieve good mixing results.

As mentioned hereinabove, the container of the present invention preferably includes a top end at which the opening is located, a bottom end that defines the supporting plane of the container, and one or more side walls that extend between the top end and the bottom end. For such a setting, it is preferred that the liquid influx reaches at least one of the side walls of such container, but only at below about 50%, preferably below about 25%, and more preferably below about 20%, of the height of the at least one side wall. Such an arrangement may function to increase the size of "vortex" created inside the container by the liquid influx while reducing/minimizing splashing of the major or minor feed. The offset angle ($\alpha$) of the liquid influx can be adjusted to ensure that the liquid influx contacts the side wall(s) of the container at the desired location as mentioned hereinabove. Further, even when the liquid influx is offset at the the same offset angle ($\alpha$), the position of the liquid nozzle can be adjusted (e.g., horizontally and/or vertically) to aim the liquid influx toward the desired location of the side wall(s) of the container and thereby further improving the mixing results.

Further, it is preferred that the supporting plane of the container has a major axis and a minor axis, while the longitudinal axis of the container intersects the major axis of the supporting plane, and while the one or more liquid influxes preferably lie within the plane defined by the longitudinal axis of the container and the major axis of its supporting plane. Such an arrangement may also lead to a greater "vortex" that is created inside the container by the liquid influx.

Note that although primarily designated for the major feed step (D), the above-described offset angle between the liquid influx and the rotational axis may also be configured during the minor feed step (i.e., step (C) as mentioned hereinabove) of the present invention.

FIG. 1 shows a perspective view of a bottle 10 having a top opening 12, a bottom supporting plane 14, and a longitudinal axis X-X that extends through the centroid of the top opening 12 and is perpendicular to the supporting plane 14. The bottle 10 has already been partially filled, e.g., to about 0.01%-50% of its total volume, with a first liquid feed composition (i.e., minor feed) containing one or more perfumes, colorants, opacifiers, pearlescent aids, enzymes, brighteners, bleaches, bleach activators, catalysts, chelants, polymers, and the like (not shown). Now it is being filled with a second liquid feed composition (i.e., major feed) containing one or more surfactants, solvents, builders, structurants, and the like (not shown), through a liquid influx 20 that enters from outside through the top opening 12 into the bottle 10. As shown by FIG. 1, the major feed liquid influx 20 is offset from the longitudinal axis X-X of the bottle 10 by an offset angle ($\alpha$), which ranges from about 1° to about 50°, preferably from about 5° to about 40°, and more preferably from about 10° to about 25°.

Although the supporting plane 14 of the bottle 10 as shown in FIG. 1 has an oval shape, it is not so limited and may have any other shapes, e.g., circular, almond, triangular, square, rectangular, and the like. In certain embodiments, the supporting plane 14 has a length-to-width ratio approximately equal to about 1. In other embodiments, the supporting plane 14 has a length-to-width ratio that is significantly greater than 1, thereby defining a major axis A that extends along its length or the longest dimension and a minor axis B that extends along its width or the shortest dimension. In such events, it is preferred that the longitudinal axis X-X of the bottle 10 intersects the major axis A of the supporting plane 14, and more preferably also the minor axis B of the supporting plane 14. It is desired that the major feed liquid influx 20 lies within the plane (not shown) defined by the longitudinal axis X-X of the bottle 10 and the major axis B of the bottom plane 14. In this manner, the major feed liquid influx 20 will be allowed the largest interior space to form the above-mentioned vortex (not shown) for optimized mixing results.

Further, it is particularly preferred that the offset angle ($\alpha$) is large enough so that the major feed liquid influx 20, after entering the bottle 10, hits one of the side walls of the bottle 10, instead of the supporting plane 14 at its bottom end. When the major feed liquid influx 30 hits one of the side walls of the bottle 10, it will be first deflected by the side wall downward to the bottom surface of the bottle 10, and then by the bottom surface for a second time to potentially reach the opposing side wall, thereby generating a relatively strong and relatively large vortex inside the bottle 10. Such vortex helps to achieve good mixing between the major feed entering the bottle 10 via the liquid influx 20 and those minor feed(s) already in the bottle 10 (not shown). In contrast, if the major feed liquid influx 20 hits the bottom surface of the bottle 10 first, it will be deflected upward to one of the side walls, but further deflection by the side wall is likely weaker in force and smaller in scale, thereby unable to form a sufficiently forceful and large vortex to achieve good mixing results. Further, when the major feed liquid influx 20 hits one of the side walls of the bottle 10 at below 50%, preferably below 25%, and more preferably below 20%, of the height of such side wall, splashing and rebounding of the liquid contents inside the bottle can be reduced to minimize adverse effect on the mixing results.

Figure 2:
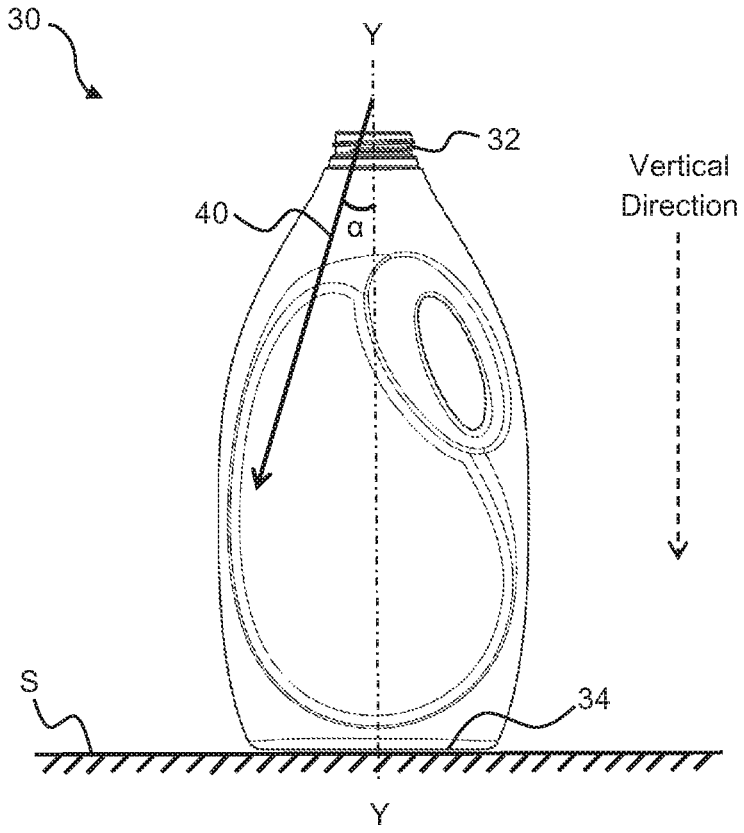
FIG. 2 is a front view of a bottle that is placed on a horizontal surface with its longitudinal axis extends along the vertical direction, while such bottle is being filled with a liquid feed composition (not shown) by a liquid influx that is offset from such a vertically extending longitudinal axis by an offset angle ($\alpha$).

FIG. 2 shows a similar bottle 30 having a top opening 32, a bottom supporting plane 34, and a longitudinal axis Y-Y that extends through the centroid of the top opening 32 and is perpendicular to the bottom supporting plane 34. The bottom supporting plane 34 of the bottle 30 sits on a horizontal surface S with the longitudinal axis Y-Y extends along (i.e., parallel to) the vertical direction. The bottle 30 has also already been partially filled, e.g., to about 0.01%-50% of its total volume, with one or more minor feeds as mentioned hereinabove (not shown). Now it is being filled with a major feed through a liquid influx 40 that enters from outside through the top opening 32 into the bottle 30. The major feed liquid influx 40 is offset from the vertically extending longitudinal axis Y-Y, as well as from the vertical direction, by an offset angle ($\alpha$), which may range from about 1° to about 50°, preferably from about 5° to about 40°, and more preferably from about 10° to about 25°.

Figure 3:
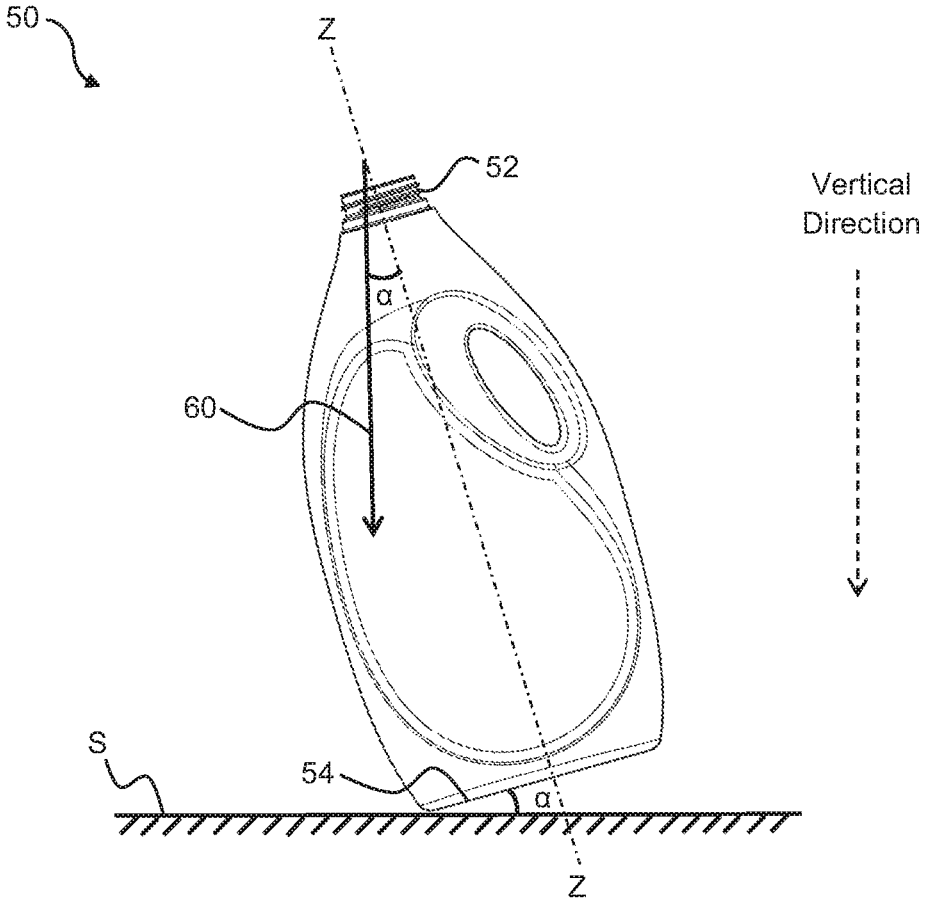
FIG. 3 is a front view of a bottle that is tilted against a horizontal surface with a tilting angle ($\alpha$), while such bottle is being filled with a liquid feed composition (not shown) by a liquid influx that extends along the vertical direction.

FIG. 3 shows another bottle 50 having a top opening 52, a bottom supporting plane 54, and a longitudinal axis Z-Z that extends through the centroid of the top opening 52 and is perpendicular to the bottom supporting plane 54. The supporting plane 54 of the bottle 50 is tilted against a horizontal surface S by a titling angle ($\alpha$), which may range from about 1° to about 50°, preferably from about 5° to about 40°, and more preferably from about 10° to about 25°. Correspondingly, the longitudinal axis Z-Z of the bottle 50 is offset from the vertical direction by the same angle ($\alpha$). The bottle 50 has also already been partially filled, e.g., to about 0.01%-50% of its total volume, with one or more minor feeds as mentioned hereinabove (not shown). Now it is being filled with a major feed through a liquid influx 60 that enters from outside through the top opening 52 into the bottle 50. The major feed liquid influx 60 extends along, or is parallel to, the vertical direction. Correspondingly, the major feed liquid influx 60 is offset from the longitudinal axis Z-Z of the bottle 50 by the same offset angle ($\alpha$).

Figure 4:
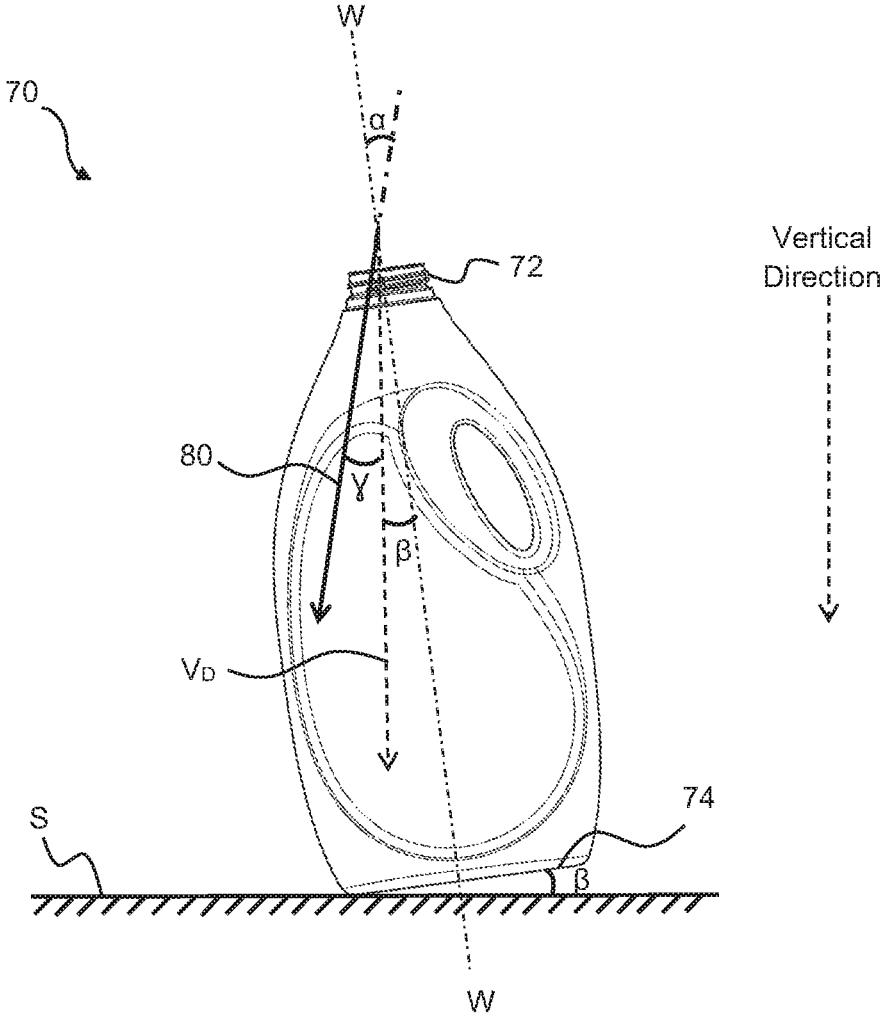
FIG. 4 is a front view of a bottle that is titled against a horizontal surface with a tilting angle ($\beta$), while such bottle is being filled with a liquid feed composition (not shown) by a liquid influx that is offset from the vertical direction by an angle ($\gamma$).

FIG. 4 shows another bottle 70 having a top opening 72, a bottom supporting plane 74, and a longitudinal axis W-W that extends through the centroid of the top opening 72 and is perpendicular to the bottom supporting plane 74. The supporting plane 74 of the bottle 70 is tilted forward against a horizontal surface S by a small titling angle ($\beta$), which may range from about 1° to about 20°, preferably from about 2° to about 15°, and more preferably from about 3° to about 10°. Correspondingly, the longitudinal axis W-W of the bottle 70 is offset from the vertical direction by the same angle ($\beta$). The bottle 70 has also already been partially filled, e.g., to about 0.01%-50% of its total volume, with one or more minor feeds as mentioned hereinabove (not shown). Now it is being filled with a major feed through a liquid influx 80 that enters from outside through the top opening 72 into the bottle 70. The major feed liquid influx 80 is offset from the vertical direction by another small angle ($\gamma$). Correspondingly, the major feed liquid influx 80 is offset from the longitudinal axis W-W of the bottle 70 by an offset angle ($\alpha$) that is equal to ($\beta$)+($\gamma$). In other words, ($\gamma$)=($\alpha$)−($\beta$).

Further, it is possible to tilt the supporting plane 74 of the bottle 70 backward against the horizontal surface S by an opposite tilting angle (−$\beta$), i.e., the left bottom end of the bottle 70 is titled up, instead of the right bottom end. Correspondingly, the major feed liquid influx 80 is then offset from the longitudinal axis W-W of the bottle 70 by an offset angle ($\alpha$) that is equal to ($\gamma$)+($-\beta$), ($\gamma-\beta$).

It is evident from FIGS. 2-4 that to achieve the desired offset angle ($\alpha$) between the liquid influx and the longitudinal axis of a container according to the present invention, the container and/or the liquid nozzle may be positioned differently in relation to the vertical direction and/or horizontal surfaces. However, it has been discovered when given the same offset angle ($\alpha$), mixing results seem better if the liquid nozzle extends vertically without any tilting (i.e., only the container being is titled to generate the desired offset angle between the liquid influx and the longitudinal axis of the container), in comparison with a titled liquid nozzle.

In order to ensure that the liquid influx(es) generated by the liquid nozzles has sufficiently high kinetic energy to create vortexes inside the container to achieve a desired mixing result, it is preferred that the liquid influx(es) has a sufficiently high velocity, e.g., with an average flow rate ranging from about 50 ml/second to about 10 L/second, more preferably from about 100 ml/second to about 5 L/second, and most preferably from about 500 ml/second to about 1.5 L/second, at least during the major feed step (D). Further, it is preferred that the liquid influx(es) has an average cross-section area ranging from about 0.1 $mm^2$ to about 100 $cm^2$, more preferably from 1 $mm^2$ to about 50 $cm^2$, and most preferably from about 5 $mm^2$ to about 10 $cm^2$.

The total time for filling the major feed during the major feed step, i.e., step (D), preferably ranges from about 0.1 second to about 5 seconds, preferably from about 0.5 second to about 4 seconds, and most preferably from about 1 second to 3 seconds.

Test Methods

A. Scale Space Method for Evaluating Goodness of Mixing

The minor feed (with at least a colorant such as a dye) and the major feed are filled sequentially into a transparent container and mixed in situ, as described hereinabove. Preferably, the transparent container is a transparent plastic bottle. The transparent plastic bottle is fitted into a rigid and non-transparent frame, both of which are then placed inside a dark room facing a Canon Rebel DSLR camera, while a LED light is placed behind such plastic bottle to provide illumination that shines through the plastic bottle into the camera.

The camera captures a digital image of each in situ mixing sample in the above-described setting ("Sample Image"). The Sample Image is then input into a computer equipped with an automated image analysis software program for calculating an overall mixing score ($Score_{mixing}$) by using a scale space image analysis technique with the following key steps:

A. Extracting an area of interest from the Sample Image to be analyzed by using edge identification filters (e.g., Sobel edge filter) and thresholding technical to remove background areas. Only the section containing the liquid mixture in the digital image of the transparent bottle is extracted, while the background areas outside of the bottle as well as the section of the bottle that does not contain the liquid mixture is excluded.

B. Conducting scale space analysis of the extracted area of interest to detect points of interest, i.e., extrema that each represents a local maximum or minimum, and to provide at least an intensity value and a size or scale for each point of interest. In the context of liquid mixtures, any of such points of interest with a sufficiently high intensity and/or a sufficiently large size is indicative of a significant local irregularity, i.e., evidence of poor mixing. Therefore, by selecting extrema having intensities and/or scales that are above a minimal threshold value, areas of significant local irregularities indicative of poor mixing can be readily and effectively detected.

C. Calculating a total irregularity score by summing up contributions from all local irregularities so detected. In the context of liquid mixtures, such a total irregularity score functions as a single quantitative measure for how good the mixing is, i.e., the overall mixing score ($Score_{mixing}$), irrespective of color and luminosity variations in the liquid mixtures.

Specifically, the following image analysis steps are carried out:

1. Convert the Sample Image to grayscale and smooth the image with a Gaussian filter;
2. Apply the Sobel edge filter, in X and Y directions, and calculate the absolute sum to enhance image edges;
3. Threshold the Sobel edge image based on a specific percentage of the maximum value (2-5% as set by the user) to avoid variability in the edge intensity in different parts of the bottle;
4. Perform a contour detection algorithm, and select only contours that have a sufficiently high internal area (i.e., excluding regions that are known to be too small to reduce potential noises) and a sufficiently high contrast/intensity (i.e., standing out versus the background);
5. Build a pyramid of images from the selected product contour using the Gaussian convolution kernel, varying the sigma (standard deviation) value at each step of a fixed amount to build a series of images each more blurred than the other. Specifically, an initial sigma value of 2.5 is used, which is multiplied by a constant value of 10 (scale steps) in each step;
6. From the scale space theory, it is known that the Difference of Gaussian (DoG), i.e., the difference between two consecutive images in the pyramid above approximates the Laplacian operator, hence local extrema value (min or max) in presence of "blobs" or "edges" can be obtained from the DoG image series;
7. From this population of local DoG extrema are selected those that have an intensity higher than a minimum value (e.g., 0.05), a minimal scale/size (e.g., 5), and a maximum local curvature (e.g., 30), all of which can be set by the user. This selection is done to avoid low intensity and/or small scale noises and to reject edge points; and
8. Once the DoG extrema of interest have been selected, the following function can be used to calculate a total mixing score ($Score_{mixing}$) indicative of how good the mixing result is in the bottle:

$$Score_{mixing} = \frac{\sum_{i=1}^{n} (DoG_i * \pi * Scale^2)}{(W * H)} \times 100$$

wherein the subscript "i" refers to each selected object (blob) detected in the Sample Image, and W and H represent the width and height of the image. Typically, the lower the $Score_{mixing}$, the better the mixing result.

Examples

Example 1: Offset Liquid Influx with Different Tilting Angles Effectuated by a Constantly Titled Nozzle and a Variably Titled Bottle A transparent plastic bottle is filled sequentially with: (1) about 4.5 grams of a blue dye premix ("Minor Feed 1"); (2)

about 25 grams of a perfume premix ("Minor Feed 2"); and (3) a bulk liquid composition containing surfactants, builders, and solvents ("Major Feed"), to reach a total filled weight of about 1400 grams.

The Major Feed is filled into the bottle by using a pressurized nozzle to generate a liquid influx into the bottle under a jet filling pressure of about 2.5 bar. The nozzle is titled at a constant angle of 25° away from the vertical direction, while the bottle is placed on a horizontal surface and can be titled at different angles, so that the liquid influx generated by the nozzle is offset from the longitudinal axis of the bottle at different offset angles effectuated by the different titling angles of the bottle.

Following are the overall mixing score ($Score_{mixing}$) calculated from digital images taken of the bottle after the Major Feed step, according to the above-mentioned Scale Space Method:

TABLE I

| Major Feed Influx Offset Angle | $Score_{mixing}$ |
|---|---|
| 0° | 11.84 |
| 12° | 3.68 |
| 25° | 11.03 |
| 32° | 14.14 |
| 41° | 11.80 |
| 45° | 13.86 |
| 54° | 15.91 |

Example 2: Offset Liquid Influx with Different Tilting Angles Effectuated by a Vertically Extending, Non-Tilting Nozzle and a Variably Titled Bottle The same bottle and same Major and Minor Feeds as those described hereinabove in Example 1 are provided.

The Major Feed is filled into the bottle also by a pressurized nozzle under the same conditions, except that this time the nozzle extends along the vertical direction without any tilting, while the bottle is placed on a horizontal surface and can be titled at different angles, so that the liquid influx generated by the nozzle is offset from the longitudinal axis of the bottle at different offset angles effectuated by the different titling angles of the bottle.

Following are the overall mixing score ($Score_{mixing}$) calculated from digital images taken of the bottle after the Major Feed step, according to the above-mentioned Scale Space Method:

TABLE II

| Major Feed Influx Offset Angle | $Score_{mixing}$ |
|---|---|
| 0° | 5.49 |
| 10° | 5.01 |
| 17° | 5.30 |
| 27° | 7.66 |
| 33° | 6.85 |

It seems that the mixing results are best when the offset angle is between 10-25°. Further, it seems that given the same offset angle between the Major Feed Influx and the longitudinal axis of the bottle, the mixing results generated by the vertically extended nozzle of Example 2 are likely better than those generated by the nozzle of Example 1, which is titled at a constant angle of 25°.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of filling a container with liquid compositions, comprising the step of:

(A) providing a container that has an opening having a centroid, a supporting plane and a longitudinal axis that extends through the centroid of said opening and is perpendicular to said supporting plane, wherein the total volume of said container ranges from about 10 ml to about 10 liters;

(B) providing a first liquid feed composition and a second liquid feed composition that is different from said first liquid feed composition;

(C) partially filling said container with the first liquid feed composition to from about 0.01% to about 50% of the total volume of said container; and (D) subsequently, filling the remaining volume of the container, or a portion thereof, with the second liquid feed composition, wherein during step (D), the second liquid feed composition is filled through the opening into said container by one or more liquid nozzles that are positioned immediately above the opening or inserted into the opening, and wherein said one or more liquid nozzles are arranged to generate one or more liquid influxes that are offset from the longitudinal axis of the container by an offset angle (α) ranging from about 1° to about 50°, and wherein the second liquid feed composition comprises one or more surfactants, solvents, builders, structurants, polymers, perfume microcapsules, pH modifiers, viscosity modifiers, or combinations thereof.

2. The method of claim 1, wherein the offset angle (α) ranges from about 5° to about 40°.

3. The method of claim 1, wherein the offset angle (α) ranges from about 10° to about 25°.

4. The method of claim 1, wherein said supporting plane of the container has a major axis and a minor axis, wherein the longitudinal axis of the container intersects the major axis of the supporting plane.

5. The method of claim 4, wherein said one or more liquid influxes are within the plane defined by the longitudinal axis of the container and the major axis of its supporting plane.

6. The method of claim 1, wherein during step (D), the container is placed so that its longitudinal axis extends along the vertical direction.

7. The method of claim 1, wherein during step (D), the container is placed so that its longitudinal axis is offset from the vertical direction by the same offset angle (α), and that said one or more liquid influxes generated by the one or more liquid nozzles extend along the vertical direction.

8. The method of claim 1, wherein during step (D), the container is placed so that its longitudinal axis is offset from the vertical direction by a second offset angle (β) that is smaller than said offset angle (α), wherein said at least one or more liquid influxes generated by the one or more liquid nozzles are offset from the vertical direction by a third offset angle (γ), and wherein (γ) is equal to (α)−(β).

9. The method of claim 1, wherein said container comprises a top end, a bottom end, and one or more side walls that extend between said top end and said bottom end, wherein the opening of said container is located at its top end, wherein the supporting plane of said container is located at its bottom end, and wherein during step (D) said one or more liquid influxes reach at least one of said side walls at below 50% of the height of said at least one side wall.

10. The method of claim 1, wherein during step (D) said one or more liquid influxes reach at least one of said side walls at below 25% of the height of said at least one side wall.

11. The method of claim 1, wherein said one or more liquid influxes are characterized by an average flow rate ranging from 50 ml/second to 10 L/second.

12. The method of claim 1, wherein said one or more liquid influxes are characterized by an average flow rate ranging from 100 ml/second to 5 L/second.

13. The method of claim 1, wherein said one or more liquid influxes are characterized by an average flow rate ranging from 500 ml/second to 1.5 L/second.

14. The method of claim 1, wherein the total time for filling the second liquid composition during step (D) ranges from 1 second to 5 seconds.

15. The method of claim 1, wherein during step (C), from 0.1% to 50% of the total volume of said container is filled with said first liquid feed composition.

16. The method of claim 1, wherein the first liquid feed composition comprises one or more perfumes, colorants, opacifiers, pearlescent aids, enzymes, brighteners, bleaches, bleach activators, catalysts, chelants, polymers, or combinations thereof, optionally where the first liquid feed composition comprises at least one pearlescent aid selected from the group consisting of mica, titanium dioxide coated mica, bismuth oxychloride, and combinations thereof.

17. The method of claim 1, wherein during step (D), at least 50% of the total volume of said container is filled with said second liquid feed composition.

18. The method of claim 1, wherein during step (D), at least 80% of the total volume of said container is filled with said second liquid feed composition.

19. A method of filling a container with liquid compositions, comprising the step of:

providing a container that has an opening having a centroid, a supporting plane and a longitudinal axis that extends through the centroid of said opening and is perpendicular to said supporting plane, wherein the total volume of said container ranges from about 10 ml to about 10 liters;

providing a first liquid feed composition and a second liquid feed composition that is different from said first liquid feed composition;

partially filling said container with the first liquid feed composition to from about 0.01% to about 50% of the total volume of said container; and subsequently, filling the remaining volume of the container, or a portion thereof, with the second liquid feed composition, wherein during step (D), the second liquid feed composition is filled through the opening into said container by one or more liquid nozzles that are positioned immediately above the opening or inserted into the opening, and wherein said one or more liquid nozzles are arranged to generate one or more liquid influxes that are offset from the longitudinal axis of the container by an offset angle (α) ranging from about 1° to about 50°, and wherein said one or more liquid influxes are characterized by an average flow rate ranging from 500 ml/second to 10 L/second.

20. The method of claim 19, wherein the offset angle (α) ranges from about 5° to about 40°.

* * * * *